United States Patent [19]

Sayles

[11] Patent Number: 4,941,931

[45] Date of Patent: Jul. 17, 1990

[54] GAS-GENERATED EXPANDABLE BEADS AS BURNING RATE ACCELERATORS

[75] Inventor: David C. Sayles, Huntsville, Ala.

[73] Assignee: The United States of America as represented by the Secretary of the Army, Washington, D.C.

[21] Appl. No.: 528,198

[22] Filed: Aug. 26, 1983

[51] Int. Cl.[5] ..... C06B 45/10

[52] U.S. Cl. ..... 149/19.2; 149/2; 149/19.4; 149/19.9; 149/20; 149/21; 252/350

[58] Field of Search ..... 149/19.2, 19.4, 2, 19.9, 149/20, 21; 252/350

[56] References Cited

U.S. PATENT DOCUMENTS

| | | | |
|---|---|---|---|
| 3,198,677 | 8/1965 | Thomas | 149/2 |
| 3,671,342 | 6/1972 | Slawinski | 149/21 |
| 3,977,922 | 8/1976 | Inoue et al. | 149/2 |
| 3,986,906 | 10/1976 | Sayles | 149/19.9 |
| 4,008,108 | 2/1977 | Chrisp | 149/2 |
| 4,019,933 | 4/1977 | Cucksee et al. | 149/19.9 |
| 4,034,675 | 2/1977 | Sayles | 149/108.8 |
| 4,092,189 | 5/1978 | Betts | 149/19.9 |
| 4,141,766 | 2/1979 | Cameron et al. | 149/2 |
| 4,151,022 | 4/1979 | Donaghue et al. | 149/19.4 |
| 4,304,185 | 12/1981 | Sayles | 149/2 |
| 4,318,760 | 3/1982 | Stephens et al. | 149/19.2 |

*Primary Examiner*—Edward A. Miller

*Attorney, Agent, or Firm*—Werten F. W. Bellamy; Jack Voight

[57] ABSTRACT

Mechanical enhancement of the burning rate of solid propellants is achieved by the incorporation of limited percentages of gas-generated-expandable beads into the solid propellant composition during propellant mixing and which are chemically crosslinked during propellant curing to a solid propellant grain. When the flame front reaches an individual bead during propellant grain burning, the bead which contains a blowing agent selected from 4-toluenesulfonyl hydrazide and 4,4'-oxybis(benzenesulfonyl hydrazide) and coated with a bead forming material consisting of about 95 parts by weight hydroxyl-terminated polybutadiene prepolymer, of about 5 parts by weight of trimethylolpropane, and of about 6 parts by weight of isophorone diisocyanate expands to several times its volume and ruptures. Bead expansion or rupture causes a disruption of the propellant's surface, and the flame can penetrate into the propellant. The penetration results in a major increase in burning rate. An increase in propellant density and an improvement in mechanical properties are achieved as a result of the beads being chemically crosslinked during propellant curing after being first physically dispersed in the propellant composition during propellant mixing.

3 Claims, No Drawings

GAS-GENERATED EXPANDABLE BEADS AS BURNING RATE ACCELERATORS

DEDICATORY CLAUSE

The invention described herein may be manufactured, used, and licensed by or for the Government for governmental purposes without the payment to me of any royalties thereon.

BACKGROUND OF THE INVENTION

The mechanism of burning rate enhancement of solid propellant compositions are generally classified as chemical or mechanical or a combination of each type.

Chemical enhancement of burning rate relates to either catalysis or chemical process interactions to yield increased burning rate, either or both of which may be influenced by or relate to surface phenomena, such as particle size, physical shapes, or mechanical interactions.

Mechanical enhancement of burning rate is, as the name implies a material that because of its shape, its distribution within a propellant matrix, and how it reacts under burning conditions can interact to affect or influence burning rate by heat transfer, by alteration of surface area or conditions, or by other physical interactions which influences the chemical and burning processes.

Various mechanical accelerators have been investigated. Some of these have been, (a) aluminum flakes, (b) aluminum staples, (c) aluminum whiskers, (d) graphite linters, (e) thermally-collapsible (shrinkable) tubings, sheets, rods, and hollow fibers, (f) microballoons, etc. Their use has been unsuccessful, when used in composite propellants, due to anisotropic burning characteristics of the propellant that these impart. The most recent material which has come to the fore as a mechanical accelerator is three-dimensional wire forms. The configuration of the wire forms is that of a paper staple in which one leg is at an angle of 90° to the other leg.

The situation, insofar as composite-modified, double-base propellant is concerned, is different from that of composite propellants because of the methods of manufacture of the propellant. This process involves the use of casting powder in combination with casting solvent. When the casting powder is loaded into the motor, it is near randomly oriented, and when solvated by the casting solvent, this produces a propellant which undergoes isotropic burning.

In my copending application Ser. No. 06/382,005, filed May 5, 1982, I disclosed the blowing agent, 4,4'-oxybis (henzenesulfonyl hydrazide) (Celogen OT, manufactured by Uniroyal, Inc., 1230 Avenue of-the-Americas, NY, NY 0110), as an additive in an amount of about 1.0–3.0 weight percent to a composite propellant composition to achieve an increase in the burning rate as a result of undergoing decomposition when in contact with the flame front during propellant burning to rupture and thereby increase the surface area of the burning propellant surface.

The specified blowing agent is disclosed as equally effective in achieving a burning rate increase by a like mechanism when employed in a composite-modified, double-base propellant composition as an additive, or as a partial or complete replacement for aluminum whiskers employed in the casting powder portion with which a casting solvent portion is combined and cured to a propellant grain.

A further improvement for mechanical enhancement of the burning rate of solid propellants wherein Celogen OT in an amount from about 5 to about 8 weight percent of heat-expandable beads is additionally disclosed in my copending application Ser. No. 06/375,892, filed May 5, 1982. These heat expandable beads are incorporated into and physically dispersed within a composite or a composite-modified, double-base propellant composition in an amount from about 29 to about 4.0 weight percent of the propellant composition. These heat-expandable beads are comprised of thermoplastic styrene or its copolymers which are employed to encapsulate Celogen OT when styrene or its copolymers and Celogen OT are tumbled together. An organic peroxide is employed to catalyze the polymerization of the styrene and bead formation.

Although the heat-expandable beads of discrete particles of thermoplastic styrene containing Celogen OT as a blowing agent has been effective as a mechanical enhancer for the burning rate of the propellant composition, additional advantages could be achieved if the blowing agent were coated or encapsulated with a polymer that is chemically crosslinked in the propellant matrix rather than be just physically dispersed as discrete particles within the solid propellant matrix.

Therefore, an object of this invention is to provide gas-generated-expandable beads as burning rate accelerators which are physically dispersed within a solid propellant composition during the mixing procedure and subsequently chemically crosslinked during propellant composition curing procedure to form a solid propellant grain.

A further object of this invention is to provide gas-generated-expandable beads which are coated with the binder ingredient having the same chemical crosslinkers as those employed in the solid propellant composition so that after incorporating the coated gas-generated expandable beads chemical crosslinking of the beads ensures that the physically dispersed mechanical enhancers for burning rate are present as chemically hound entities in the cured solid propellant matrix which contribute to the increased density value and improved mechanical properties in addition to providing increased burning rate.

Still a further object of the invention is to provide a solid propellant composition with an improved burning rate while containing less carborane as a burning rate catalyst to thereby result in a less costly solid propellant composition as a result of containing a chemically crosslinked mechanical enhancer for burning rate as a direct replacement for a portion of the carborane burning rate catalyst.

SUMMARY OF THE INVENTION

Mechanical enhancement of the burning rate of solid propellants is achieved as a result of the incorporation into the solid propellant composition limited percentages of gas-generated-expandable beads of a blowing agent selected from 4-toluenesulfonyl hydrazide and 4,4'-oxybis(benzenesulfonyl hydrazide) encapsulated or coated in spherical form to facilitate uniform dispersion throughout the propellant matrix where it is subsequently chemically crosslinked during the propellant curing procedure. The composition employed to coat the selected blowing agent consists of about 95% by weight hydroxyl-terminated polybutadiene prepolymer, about 5% by weight of trimethylolpropane, and about 6% by weight isophorone diisocyanate. The common ingredients for coating the blowing agent as employed in the solid propellant composition are first formed to the shape of spherical beads which are chemically crosslinked after being physically dispersed in an uncured propellant composition to thereby form a part of the binder matrix as a result of crosslinking of the coated spherical bead within the binder matrix. When the flame front of the burning propellant reaches the gas-generated-expandable bead that is physically dispersed and chemically crosslinked, the blowing agent present in the bead will cause the bead to expand several times its volume and rupture. Bead expansion or rupture will bring about disruption of the propellant's surface, and the flame penetrates into the propellant. This penetration results in a major increase in burning rate due to the many additional burning surface areas generated The gas-generated-expandable beads are employed with a composite propellant composition employing a hydroxyl-terminated polybutadiene prepolymer binder containing trimethylolpropane, a bonding agent, and a diisocyanate crosslinking agent. The beads are employed as a replacement for about 2.0 to about 4.0 percent of the carboranyl burning rate catalyst. The beads are chemically crosslinked after being intimately dispersed in the propellant composition.

DESCRIPTION OF THE PREFERRED EMBODIMENT

Composite propellants have enhanced burning rates when gas-generated-expandable beads of discrete particles of a polybutadiene encapsulated or coated blowing agent selected from 4-toluenesulfonyl hydrazide and 4,4'-oxybis(benzenesulfonyl hydrazide) are incorporated into the matrix of the propellant in an amount from about 2.0 to about 4.0 weight percent as a replacement for this weight percent of carboranyl burning rate catalyst. Since the polybutadiene coated bead has the same curing agents and binder ingredients contained in the solid propellant composition a chemically crosslinked mechanical enhancer is present in the matrix of the propellant after it is first physically dispersed during the mixing of the propellant composition. An increase in propellant density is achieved in addition to the improvement to mechanical properties and enhanced burning rate. Bead expansion or rupture when exposed to the flame front of burning propellant brings about disruption of the propellant's surface, and the flame can penetrate into the propellant. This penetration brings about a major increase in burning rate.

The incorporation of mechanical burning rate augmenters into ultrahigh burning rate solid propellants is presently considered to be essential to achieve the burning rate regimes of current interest for use in advanced interceptors. A combination of mechanical and chemical rate accelerators results in the following beneficial effects over that of chemical accelerators alone:

a. The combination produces a higher burning rate than can be achieved using either accelerator by itself;

b. The combination results in a considerable reduction in the amount of chemical accelerator required to obtain a particular burning rate;

c. Any approach that reduces the amount of chemical accelerator that is needed means a major reduction in the cost of the propellant;

d. The problems associated with migration of the liquid chemical accelerator to the surface of the propellant and into the liner-barrier-insulation is reduced;

e. The loss of chemical accelerator because of its volatility is also reduced.

The carboranyl-catalyzed, hydroxyl-terminated polybutadiene-based propellants require about 9% carborane to produce the ultrahigh-burning rates for advanced interceptors (9–10 ips @2000 psi.) whereas, the carboranyl-catalyzed, composite-modified double-base propellant, containing 2.9% aluminum whiskers, only needs 4.7% corboranylmethyl propionate to produce the same burning rate Since the present price of carborane ranges between $2000–$3000 per pound, it is understandable why the composite-modified, double-base propellants were selected for further exploitation. Since there is a larger production capacity for the manufacture of composite propellants, it is desirable to take advantage of this factor. The incorporation of gas-generator-expandable beads can make this a reality.

Table I provides a comparison of the composition and characteristics of composite propellants with and without gas-generated-expandable beads and is representative of the type of burn rate enhancement that can be achieved.

TABLE I

COMPOSITION AND CHARACTERISTICS OF A COMPOSITE PROPELLANT WITHOUT AND WITH GAS-GENERATED-EXPANDABLE BEADS

| | PROPELLANT | |
|---|---|---|
| COMPOSITION | A | B |
| Aluminum powder (Alcoa 5341) | 12.0 | 12.0 |
| Ammonium perchlorate (70 μm) | 73.0 | 73.0 |
| n-Hexylcarborane | 9.0 | 6.0 |
| Hydroxyl-terminated polybutadiene prepolymer | 6.0 | 6.0 |
| Trimethylolpropane (additive) | 0.06 | 0.06 |
| BA-114* (additive) | 0.3 | 0.3 |
| Isophorone diisocyanate (additive) | 0.7 | 0.7 |
| Gas-generated-expandable beads | 0.0 | 3.0 |
| *Reaction product of 12-hydroxystearic acid and tris[2-methylaziridinyl]phosphine oxide | | |
| MECHANICAL PROPERTIES | | |
| Tensile strength [PSI] | 260 | 300–350 |
| Strain @ max. stress [%] | 17 | 45–50 |
| Modulus [PSI] | 1700 | 1200 |
| Density [LB/IN$^3$] | 0.062 | 0.063 |
| BALLISTIC PROPERTIES | | |
| Strand burning rate [$r_{2000}$] [IPS] | 9.00 | 11.2 |

Coating of the 4,4'-oxybis(benzenesulfonyl hydrazide) with crosslinked hydroxyl-terminated polybutadiene prepolymer is accomplished through the use of a vertical coating unit. A mixture consisting of the following composition:

Hydroxyl-terminated polybutadiene prepolymer: 95%
Trimethylolpropane: 5
Isophorone diisocyanate: 6
can be used as the coating material.

In this process, the bead forming material and the hydrazide are transferred from separate storage hoppers by means of airveying units (using nitrogen as the conveyor gas) into the coating unit which is maintained continuously agitated and heated to 175°–205° F.

The coating unit can be a horizontal, cylindrical, insulated vessel with a motor-driven horizontal shaft to which numerous teflon-coated bars are attached. Teflon-coated stationary horizontal bars can also be mounted slightly off-center across the vessel, clear of interference with the moving bars.

The hydrazide can be fed into the side of the vessel at or near the bottom by an airveying unit. The coating mixture is injected through a spray head from near the top of the vessel. The stirring is necessary to prevent agglomeration or lumping.

The blowing agents that are usable in this application are:

(a)

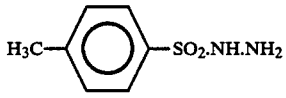

4-toluenesulfonyl hydrazide (b)

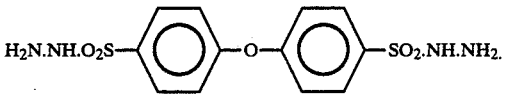

4,4'-oxybis(benzenesulfonyl hydrazide)

Other hydrazides are usable in the preparation of the gas-generated-expandable beads. This investigation focused the use of the 4,4'-oxybis(benzenesulfonyl hydrazide).

A determining factor in the selection of what blowing agent to use is the decomposition range. For 4-toluenesulfonyl hydrazide, the decomposition range is 110°–120° C. (230°–250° F.) and for the 4,4'-oxybis(benzenesulfonyl hydrazide), the decomposition range is 158°–160° C. (315°–320° F.). Since the decomposition ranges are well above the normal cure temperature of solid propellants, no decomposition of these expandable beads was encountered during propellant cure.

The decomposition mechanism of the 4,4'-oxybis(-benzenesulfonyl hydrazide) is as follows:

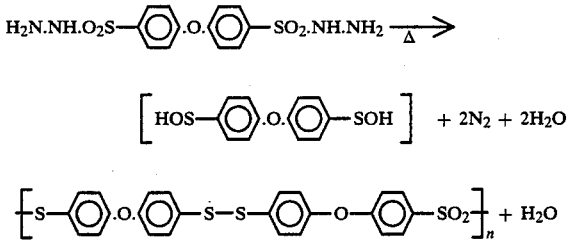

On decomposition, 125 ml of gases are produced when measured under Standard Temperature and Pressure (STP) condition per mole. The composition of the gases which are generated on the decomposition of this hydrazide was 91% nitrogen and 9% water.

I claim:

1. In a composite propellant composition consisting essentially in weight percents of the ingredients as follows:

| | |
|---|---|
| aluminum powder | 12.0 |
| ammonium perchlorate (70 μm) | 73.0 |
| n-hexylcarborane | 6.0 |
| hydroxyl-terminated polybutadiene prepolymer | 6.0 |
| trimethylolpropane (additive) | 0.06 |
| wetting agent (reaction product of equimolar quantities of 12-hydroxystearic acid and tris[2-methylaziridinyl]phosphine oxide) (additive) | 0.30 |
| isophorone diisocyanate (additive) | 0.70; |

the improvement in burning rate achieved by incorporation into said composite composition during propellant mixing from about 2.0 to about 4.0 weight percent of gas-generated-expandable beads comprised of a blowing agent selected from 4-toluenesulfonyl hydrazide and 4,4'-oxybis(benzenesulfonyl hydrazide) which is coated with a bead forming material consisting of about 95 parts of hydroxy-terminated polybutadiene prepolymer, of about 5 parts of trimetholol propane, and of about 6 parts of isophorone diisocyanate, said coated gas-generated-expandable beads being physically dispersed in said composite propellant composition and chemically crosslinked in said composite propellant composition during curing of said composite propellant composition to form a solid propellant grain, said gas-generated-expandable beads containing about 5–8% by weight of said selected blowing agent that results in bead expansion or rupture during propellant burning when the flame front reaches said gas-generated-expandable bead, said bead expansion or rupture bringing about disruption of the propellant's surface to permit flame penetration into the propellant to thereby achieve a major increase in burning rate of said propellant composition.

2. In the propellant composition of claim 1 wherein said improvement in burning rate is achieved by the incorporation of about 3.0 weight percent of said gas-generated-expandable beads containing said selected blowing agent of 4,4'-oxybis(benzenesulfonyl hydrazide) into said composite propellant composition.

3. In the propellant composition of claim 1 wherein said improvement in burning rate is achieved by the incorporation of about 3.0 weight percent of said gas-generated-expandable beads containing said selected blowing agent of 4-toluenesulfonyl hydrazide into said composite propellant composition.

* * * * *